United States Patent [19]

Simons

[11] Patent Number: 4,757,865

[45] Date of Patent: Jul. 19, 1988

[54] FAST RESPONSE SPRINKLER HEAD

[75] Inventor: John R. Simons, Greendale, Wis.

[73] Assignee: Star Sprinkler Corporation, South Milwaukee, Wis.

[21] Appl. No.: 932,706

[22] Filed: Nov. 19, 1986

[51] Int. Cl.[4] ..... A62C 37/12

[52] U.S. Cl. ..... 169/39; 169/42

[58] Field of Search ..... 169/37–42, 169/90, 91

[56] References Cited

U.S. PATENT DOCUMENTS

| | | | |
|---|---|---|---|
| 1,195,593 | 8/1916 | Kersteter | 169/39 X |
| 1,919,235 | 7/1933 | Loepsinger | 169/39 |
| 3,866,686 | 2/1975 | Goodsell, Jr. et al. | 169/39 |
| 4,273,195 | 6/1981 | Fischer et al. | 169/39 |

*Primary Examiner*—Galen Barefoot
*Assistant Examiner*—Paul E. Salmon
*Attorney, Agent, or Firm*—Andrus, Sceales, Starke & Sawall

[57] ABSTRACT

A fast response sprinkler head. The sprinkler head includes a frame having a base portion connected to a source of water under pressure and a pair of arms extended outwardly from the base and are connected at a junction. A cap normally encloses the outlet in the base and a lever assembly, which extends between the junction and the cap, holds the cap in the closed position. The lever assembly includes a pair of lever members, with one of the lever members being biased in a direction away from the other lever member. A fusible link assembly interconnects the lever members and includes a pair of thin metal sheets that are joined together by a layer of fusible metal or solder. Each sheet is formed with a recess in one side edge and the recesses face each other to define an opening which receives the lever member. The corners of each sheet are bent generally normal to the sheet to provide fins or tabs. The fins increase the rate of heat transfer to the fusible metal to cause rapid release of the lever assembly to open the outlet.

9 Claims, 1 Drawing Sheet

FAST RESPONSE SPRINKLER HEAD

BACKGROUND OF THE INVENTION

Automatic sprinkler heads, as used in commercial and industrial buidings, include a cast metal frame having a base that defines an outlet connected to the water piping system. The frame also includes a pair of arms that extend outwardly from the base and are connected together at a junction. The outlet in the base is normally enclosed by a cap, which is held in the closed position by a lever assembly, that extends between the cap and the junction. The lever assembly includes a pair of lever members, with one of the lever members being normally biased in a direction away from the other.

In the conventional sprinkler head, a fusible link, including a fusible element or metal, retains the lever assembly in position to close off the outlet. On exposur to an elevated temperature, the fusible metal will melt, releasing the link and the lever assembly to open the outlet to the water line.

The primary use in the past of automatic sprinkler systems has been for property protection in commercial and industrial applications, such as warehouses, stores, buildings and the like. With the recent increased use of sprinkler systems in hospitals, hotels, nursing homes and residences, where the prime object is to save human life as opposed to property protection, there is a demand for a faster response sprinkler head, meaning one that will release more quickly when exposed to elevated temperatures.

U.S. Pat. No. 4,273,195, discloses a fast response sprinkler head, in which the fusible link that retains the lever assembly in the engaged position includes a pair of their copper sheets connected by a layer of solder. Each sheet has an opening to receive one of the lever members. The major portion of the fusible link of the aforementioned patent is located between the lever members in a location where the lever members tend to shield the central portion of the link. Because of this, a side edge of each sheet is formed with an angular wing which is disposed at an acute angle to the sheet and is designed to direct heated air onto the central portion of the fusible link.

SUMMARY OF THE INVENTION

The invention is directed to an improved fast response sprinkler head. In accordance with the invention, the fusible link assembly includes a pair of thin metal sheets, preferably formed of copper, which are joined together by a layer of fusible metal or solder. Each sheet has a generally C-shaped configuration with a recess along one edge. The sheets are positioned so that the recesses face each other and define an opening which receives the lever members of the lever assembly. The corners of each sheet are bent generally normal to the sheet to provide tabs or fins which increase the frontal area exposed to the heat of combustion, thereby increasing the rate of heat transfer to the fusible link and achieving a faster response time.

By positioning the metal sheets of the fusible link assembly at an angle to the horizontal, a further increase in the surface area exposed to the upward flow of heated gas can be obtained.

The sprinkler head of the invention has a very fast response achieved by the orientation of the fusible link assembly and the incorporation of bent tabs or fins.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
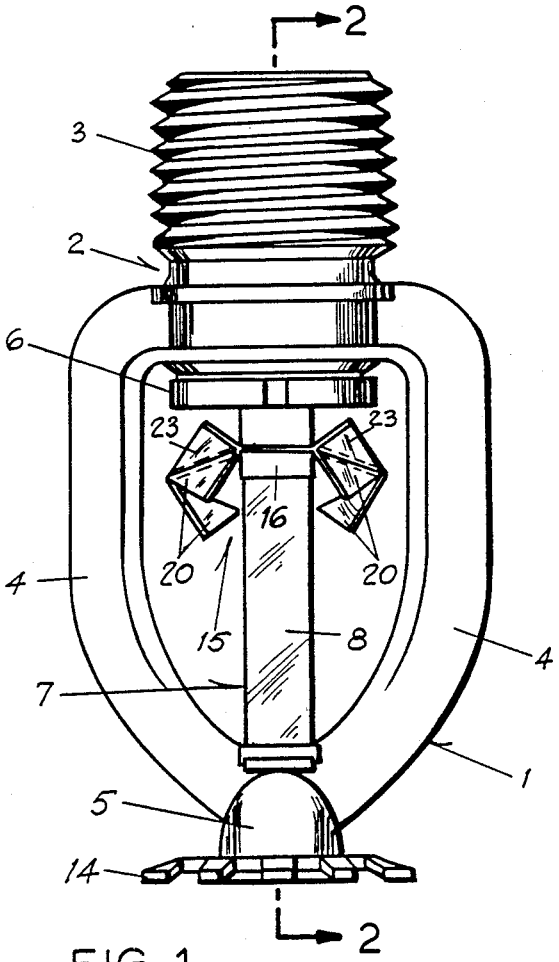
FIG. 1 is a front elevation of the sprinkler head of the invention.

The drawings illustrate an improved fast response sprinkler head which includes a cast metal frame 1 having a base portion 2 that includes a threaded outlet 3 which is adapted to be connected to a water piping system. Frame 1 also includes a pair of generally curved arms 4 which extend downwardly from base 2 and are connected at a juncture 5.

Outlet 3 is normally enclosed by a cap 6 which is held in the closed position by a lever assembly 7. Lever assembly 7 is composed of a first lever member or strut 8 and a second lever member or spring 9.

Figure 2:
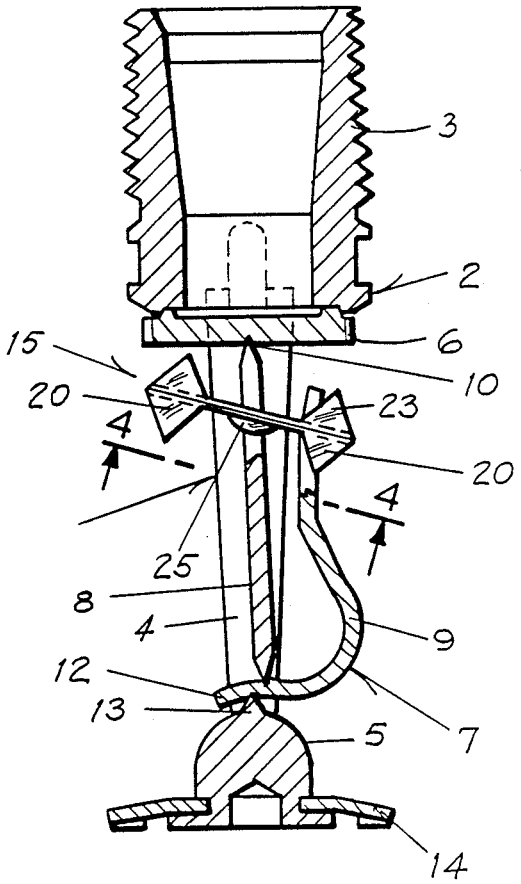
FIG. 2 is a section taken along line 2—2 of FIG. 1.

As best shown in FIG. 2, one end of strut 8 is engaged with a groove 10 formed in cap 6, while the other end of strut 8 is in contact with the end 12 of spring 9. As illustrated in FIG. 2, the tip of a projection 13 on juncture 5, is engaged with a groove in end 12 of spring 9 while the end of the strut 8 is engaged with a second groove in the end 12 of lever member 9 at a location which is offset from the tip of projection 13. Due to the offset position of the grooves in end 12, spring 9 will be biased outwardly away from strut 8, as shown in FIG. 2.

A deflector 14 is mounted on the outer end of frame 1 and serves to deflect the water emerging from outlet 3 in the desired spray pattern., In accordance with the invention a fusible link assembly 15 maintains the lever members 8 and 9 in position to retain cap 6 in the closed condition. Assembly 15 is composed of a pair of sheets 16 and 17, preferably formed of copper or other metal having a high coefficient of thermal conductivity. Sheets 16 and 17 are in lapping relation and are joined together by a layer of a fusible metal or solder 18.

Figure 3:
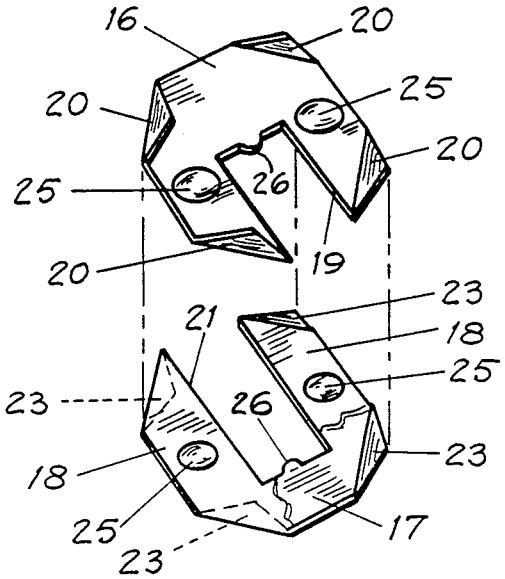
FIG. 3 is an exploded perspective view of the metal sheets of the fusible link assembly.

As best shown in FIG. 3, sheet 16 is generally square in shape and one side edge is formed with a recess 19. The corners of sheet 16 are bent upwardly to form generally triangular tabs or fins 20, which are non-parallel and are located generally normal to the sheet 16 itself.

Similarly, sheet 17 is also square in shape and one side edge is provided with a recess 21. Recesses 19 and 21 face each other and define an opening 22, which receives the lever members 8 and 9, as shown in FIG. 4.

The corners of sheet 17 are bent downwardly to form non-parallel tabs or fins 23, which are normal to sheet 17 and extend in the opposite direction from the tabs 20. When assembled, fins 20 on sheet 16 are aligned with corresponding fins 23 on sheet 17 to provide generally square flanges or surfaces that extend normal to sheets 16 and 17, as best shown in FIGS. 1 and 2. As shown in the drawings, fins 20 and 23 each lie in a single plane.

To provide increased resistance to shear force, the sheets 16 and 17 are provided with mating dimples or projections 25. As shown in FIG. 3, the fusible material or solder 18 extends along the entire interface between the sheets 16 and 17, including the mating dimples 25, so that the fusible metal will be subjected to tension stress, as opposed to shear stress.

Figure 4:
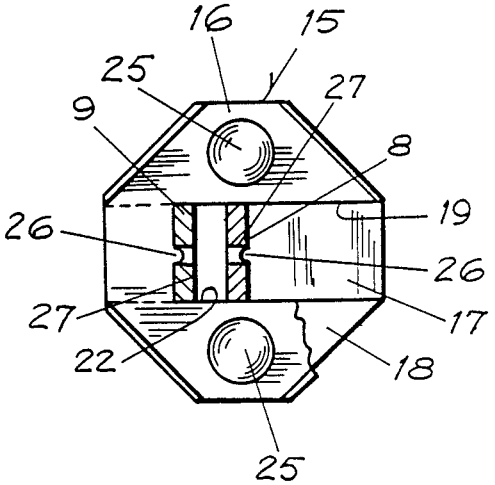
FIG. 4 is a section taken along line 4—4 of FIG. 2.

To prevent longitudinal movement of the lever members 8 and 9 relative to the sheets 16 and 17, the sheets are provided with prongs 26 at the base of the respective recesses 19 and 21 and the prongs, as shown in FIG. 4, are disposed in holes 27 in the respective lever members 8 and 9.

The fins 20 and 23 are not intended to direct heated air across sheets 16 and 17, but instead function to provide increased frontal area for exposure to the flowing heat of combustion to thereby increase the rate of heat transfer to the fusible metal 18. A further improvement in the rate of heat transfer can be achieved by positioning the sheets 16 and 17 at an angle of 10° to 30° with respect to the horizontal, as shown in FIG. 2.

When the sprinkler head is exposed to the heat of combustion, the heat will flow upwardly along the lower sheet 17, as well as across the exposed fins 20 and 23. Thus, the increased surface area provided by fins 20 and 23 substantially improves the rate of heat transfer to the fusible metal 18, with the result that a faster response time is achieved.

In the construction of the invention, the strut 8 and spring 9 are in close proximity within opening 22 and as a result the fusible metal layer 18 is located outwardly of the opening 22 in a position where the strut and spring will not shield the fusible layer from the flow of the heat of combustion.

Various modes of carrying out the invention are contemplated as being within the scope of the following claims particularly pointing out and distinctly claiming the subject matter which is regarded as the invention.

I claim:

1. A fast response sprinkler head, comprising a frame having an outlet to be connected to a source of water under pressure and having a pair of arms extending outwardly from said outlet and connected at a junction, a cap to normally enclose said outlet, a lever assembly connected between the cap and junction to hold the cap in a closed position, said lever assembly including a pair of lever members, a first of said lever members being biased in a direction away from a second of said lever members, a fusible link interconnecting the lever members and including a pair of thin metal sheets disposed in partially overlapping relation, said fusible link also including a layer of fusible metal disposed between the overlapping portions of said sheets, each sheet having a recess in a side edge with said recesses communicating with each other to define an opening to receive said lever members, at least one side edge of each sheet being bent at approximately 90° to the sheet to provide a plurality of non-parallel fins, the fins on one sheet extending in the opposite direction from the fins on the other sheet; each fin lying in a single plane disposed at an acute angle to both the horizontal and vertical, said fins increasing the frontal area to the flow of hot gases to increase the rate of heat transfer to said fusible metal.

2. The sprinkler head of claim 1, wherein said sheets are provided with mating protrusions and said fusible metal is disposed between said protrusions.

3. A fast response sprinkler head, comprising a frame having an outlet to be connected to a source of water under pressure and having a pair of arms extending outwardly from said outlet and connected at a junction, a cap to normally enclose said outlet, a lever assembly connected between the cap and junction to hold the cap in a closed position, said lever assembly including a pair of lever members, a first of said lever members being biased in a direction away from a second of said lever members, a fusible assembly interconnecting the lever members and including a pair of thin metal sheets disposed in partially overlapping relation, said fusible assembly also including a layer of fusible material disposed between the overlapping portions of said sheets, each sheet being generally rectangular in shape and having a recess in a side edge with said recesses communicating with each other to define an opening to receive said lever members, each corner of each sheet being disposed generally normal to said sheet to define generally triangular fins, the fins on one sheet extending in the opposite direction with respect to the fins on the other sheet, said fins increasing the surface area exposed to the heat of combustion to thereby substantially improve the rate of heat transfer to said fusible material.

4. The sprinkler head of claim 3, wherein said sheets have mating surface deviations, said fusible material being disposed between said mating surface deviations.

5. The sprinkler head of claim 4, wherein a fin of one sheet is aligned with a fin of the other sheet to define a generally rectangular flange.

6. The sprinkler head of claim 3, wherein said sheets are disposed at an acute angle to the longitudinal axis of said head.

7. A fast response sprinkler head, comprising a frame having an outlet to be connected to a source of water under pressure and having a pair of arms extending outwardly from said outlet and connected at a junction, a cap to normally enclose said outlet, a lever assembly connected between the cap and junction to hold the cap in a closed position, said lever assembly including a pair of lever members, a first of said lever members being biased in a direction away from a second of said lever members, a fusible assembly interconnecting the lever members and including a pair of thin sheets disposed in lapping relation, said fusible assembly also including a layer of a fusible metal disposed between the overlapping portions of said sheets, said sheets having aligned openings to receive said lever members, at least one of said sheets having a pair of side edges meeting at a corner, said side edges being bent at an angle to said sheet to provide a generally triangular fin at said corner, said fin being disposed at an angle to both the horizontal and the vertical.

8. A fast response sprinkler head, comprising a frame having an outlet to be connected to a source of water under pressure and having a pair of arms extending outwardly from said outlet and connected at a junction, a cap to normally enclose said outlet, a lever assembly connected between the cap and junction to hold the cap in a closed position, said lever assembly including a pair of lever members, a first of said lever members being biased in a direction away from a second of said lever members, a fusible link interconnecting the lever members and including a pair of thin metal sheets disposed in partially overlapping relation, said fusible link also including a layer of fusible metal disposed between the overlapping portions of said sheets, each sheet having a recess in a side edge with said recesses communicating with each other to define an opening to receive said lever members, each sheet being generally square in shape and each corner of each sheet being bent to provide a generally triangular fin, the fin at one corner of a first of said sheets being aligned with a fin at a corner of a second of said sheets to provide a generally square flange.

9. A fast response sprinkler head, comprising a frame having an outlet to be connected to a source of water under pressure and having a pair of arms extending outwardly from said outlet and connected at a junction, a cap to normally enclose said outlet, a lever assembly connected between the cap and junction to hold the cap in a closed position, said lever assembly including a pair of lever members, a first of said lever members being biased in a direction away from a second of said lever members, a fusible assembly interconnecting the lever members and including a pair of thin sheets disposed in lapping relation, said fusible assembly also including a layer of a fusible metal disposed between the overlappig portions of said sheets, said sheets having aligned openings to receive said lever members, a side edge of each of said sheets having a fin extending at an angle to the respective sheet, said fin extending in opposite directions and are aligned to provide a generally rectangular flange disposed at an angle to both the horizontal and vertical, said fins increasing the rate of heat transfer of said fusible metal.

* * * * *

UNITED STATES PATENT AND TRADEMARK OFFICE

CERTIFICATE OF CORRECTION

PATENT NO. : 4,757,865

DATED : July 19, 1988

INVENTOR(S) : JOHN R. SIMONS

It is certified that error appears in the above-identified patent and that said Letters Patent is hereby corrected as shown below:

| | |
|---|---|
| Col. 3, Line 60, CLAIM 1 | Delete ";" and substitute therefor ---,--- |
| Col. 6, Line 4, CLAIM 9 | Delete "overlappig" and substitute therefor ---overlapping--- |
| Col. 6, Line 8, CLAIM 9 | Delete "fin" and substitute therefor ---fins--- |
| Col. 6, Line 11, CLAIM 9 | Delete the second occurrence of "of" and substitute therefor ---to--- |

Signed and Sealed this

Tenth Day of October, 1989

*Attest:*

*Attesting Officer*

DONALD J. QUIGG

*Commissioner of Patents and Trademarks*